US005236376A

United States Patent [19]

Cohen

[11] Patent Number: 5,236,376

[45] Date of Patent: Aug. 17, 1993

[54] CONNECTOR

[76] Inventor: Amir Cohen, Moshav Be'er Tuvia, 70996, Israel

[21] Appl. No.: 837,919

[22] Filed: Feb. 20, 1992

[30] Foreign Application Priority Data

Mar. 4, 1991 [IL] Israel ..... 97425

[51] Int. Cl.[5] ..... H01R 13/66

[52] U.S. Cl. ..... 439/620; 361/56; 361/111; 333/185

[58] Field of Search ..... 439/620; 361/56, 111; 333/181-185

[56] References Cited

U.S. PATENT DOCUMENTS

| | | | |
|---|---|---|---|
| 3,710,285 | 1/1973 | Schor et al. | 333/79 |
| 3,961,294 | 6/1976 | Hollyday | 439/620 |
| 4,126,370 | 11/1978 | Nijman | 333/79 |
| 4,484,159 | 11/1984 | Whitley | 333/182 |
| 4,494,092 | 1/1985 | Griffin | 333/182 |
| 4,580,866 | 4/1986 | Hagner | 333/181 |
| 4,673,237 | 6/1987 | Wadsworth | 439/620 |
| 4,726,790 | 2/1988 | Hadjis | 439/620 |
| 4,729,743 | 3/1988 | Farrar et al. | 439/620 |
| 4,889,497 | 12/1989 | Riches | 439/620 |
| 5,034,846 | 7/1991 | Hodge et al. | 439/620 |

*Primary Examiner*—Gary F. Paumen
*Attorney, Agent, or Firm*—Nixon & Vanderhye

[57] ABSTRACT

A filter connector including a housing, a plurality of connector terminals, at least one printed circuit board having mounted thereon surface mounted filter components and apparatus for providing electrical connections between the surface mounted filter components and the plurality of connector terminals.

8 Claims, 8 Drawing Sheets

CONNECTOR

FIELD OF THE INVENTION

The present invention relates to electrical connectors generally and more particularly to filtered electrical connectors.

BACKGROUND OF THE INVENTION

Various types of filtered electrical connectors are known in the patent literature.

U.S. Pat. No. 3,710,285 described a filter pin connector having low ground return impedance in which a plurality of ground planes establish a low impedance ground return circuit for a filter pin connector comprising a connector pin, a tubular filter, and a housing.

U.S. Pat. No. 3,961,294 describes a connector having a filter adaptor in which a conducting shell within which filters and pins or sockets are secured is adapted for mounting to an existing connector.

U.S. Pat. No. 4,126,370 describes a filter connector with radial mounting means including a tubular electrical interference filter mounted coaxially about an electrical conductor in a dielectric insert.

U.S. Pat. No. 4,484,159 describes a filter connector with discrete particle dielectric, which avoids breakage of the dielectric.

U.S. Pat. No. 4,494,092 describes a filter pin electrical connector having two capacitor disc assemblies, each with a plurality of openings receiving the connector pins and held within a connector shell.

U.S. Pat. No. 4,580,866 describes an electrical connector assembly having an electromagnetic interference filter which includes a filtering interface having an electrically non-conductive body provided with a plurality of generally parallel grooves for receiving respective individual capacitors.

U.S. Pat. No. 4,729,743 describes a filtered electrical connector having both transient suppression and filtering means and which includes a conductive housing member having an axially extending passageway and a dielectric substrate located therein having a plurality of apertures extending therethrough for receiving electrical terminal members.

SUMMARY OF THE INVENTION

The present invention seeks to provide an improved electrical connector having filtering capability.

There is thus provided in accordance with a preferred embodiment of the present invention a filter connector including a housing, a plurality of connector terminals, at least one printed circuit board having mounted thereon surface mounted filter components and apparatus for providing electrical connections between the surface mounted filter components and the plurality of connector terminals.

For the purposes of the present specification and claims, the phrase "printed circuit board having mounted thereon surface mounted filter components" is used to designate printed circuits having components surface mounted onto the principal planar surface thereof, as distinguished from mounting in recesses as in the prior art, and to designate hybrid circuits as well.

In accordance with one preferred embodiment of the invention, the apparatus for providing electrical connections comprises a plurality of circuit board edge connectors.

In accordance with another preferred embodiment of the invention, the apparatus for providing electrical connections comprises a plurality of plated through apertures in at least one circuit board for accommodating connector pins.

In accordance with a preferred embodiment of the invention, the at least one printed circuit board having mounted thereon surface mounted filter components and the apparatus for providing electrical connections between the surface mounted filter components and the plurality of connector terminals are all incorporated in a single hybrid element.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
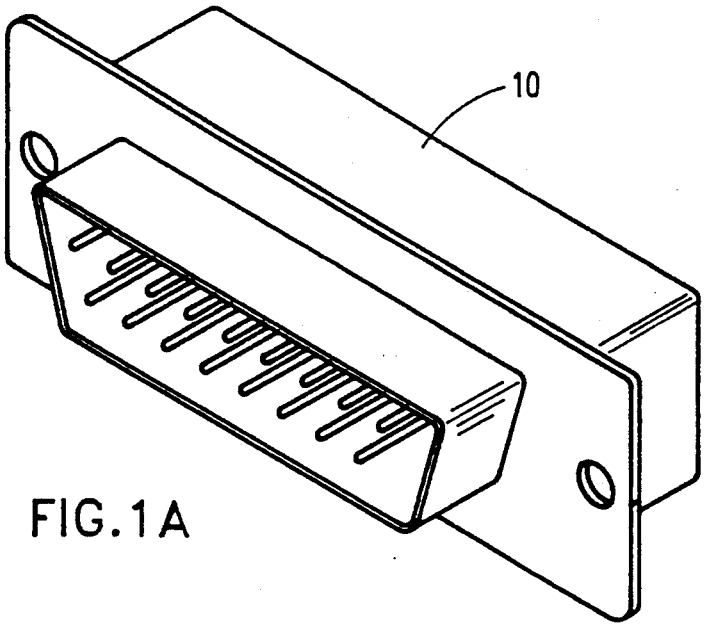
FIGS. 1A and 1B are respective pictorial and exploded views of an electrical connector constructed and operative in accordance with a preferred embodiment of the present invention.
Figure 1B:
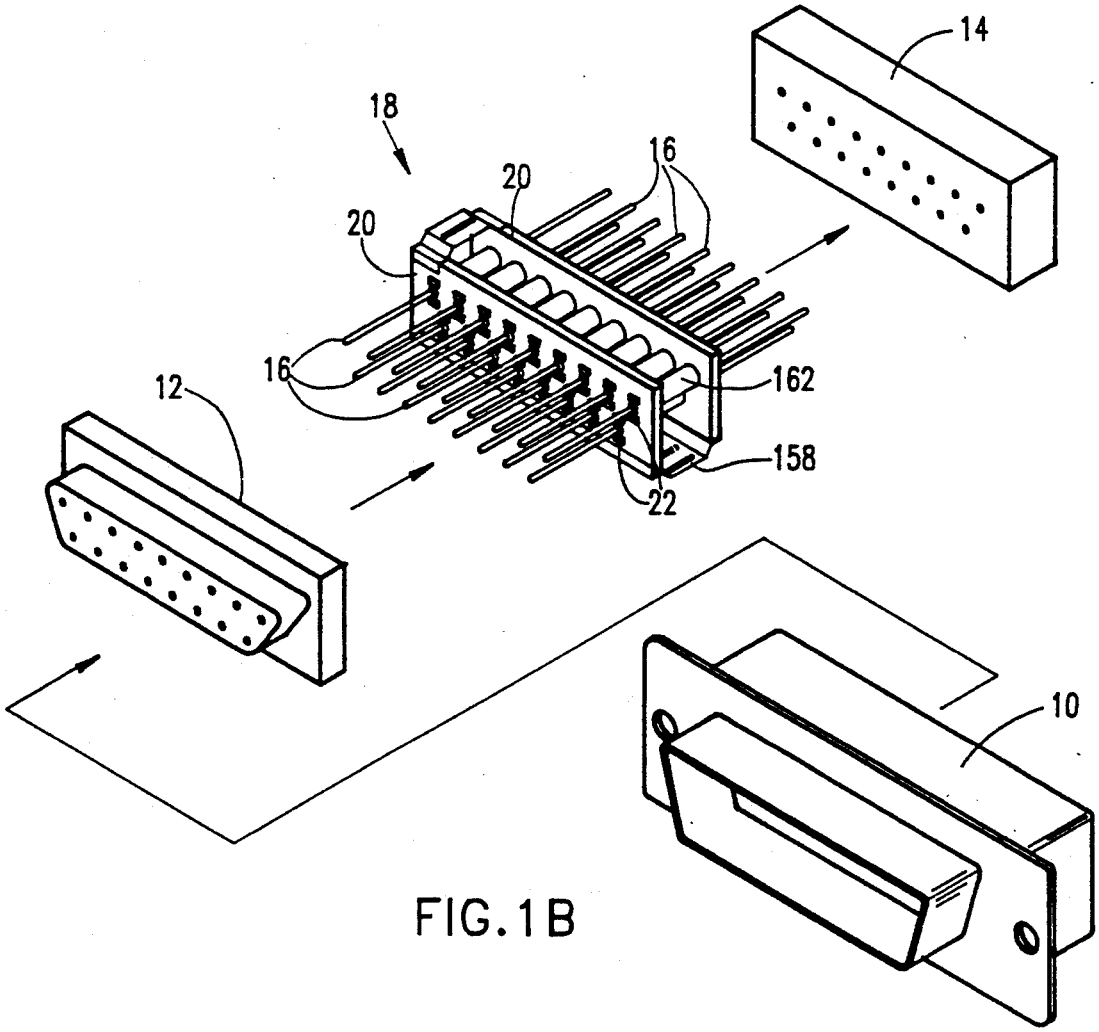

Reference is now made to FIGS. 1A and 1B, which illustrate an electrical connector constructed and operative in accordance with a preferred embodiment of the present invention. The connector comprises a conductive housing 10, typically formed of aluminum or stainless steel, which surrounds a connector assembly including forward and rear perforated insulated blocks 12 and 14, typically formed of a ceramic or plastic material, through the apertures of which extend pins 16 forming part of a filter assembly 18.

In accordance with a preferred embodiment of the present invention, filter assembly 18 comprises at least one and preferably at least two printed circuit boards 20 having surface mounted thereon filter circuits 22 which provide desired transient suppression and filtering for protection of electrical and electronic equipment from spurious energy inputs, including for example, EMI, RFI and EMP.

Figure 14A:
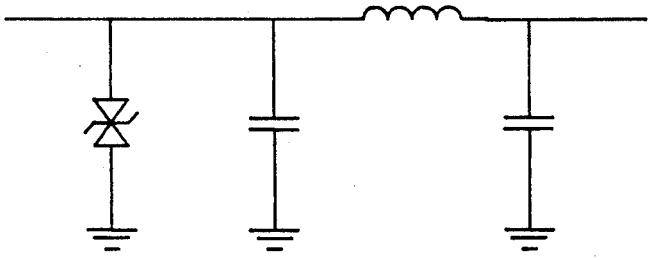
FIGS. 14A and 14B are circuit diagrams of various typical filtering circuits which may be employed in various embodiments of the invention.
Figure 14B:
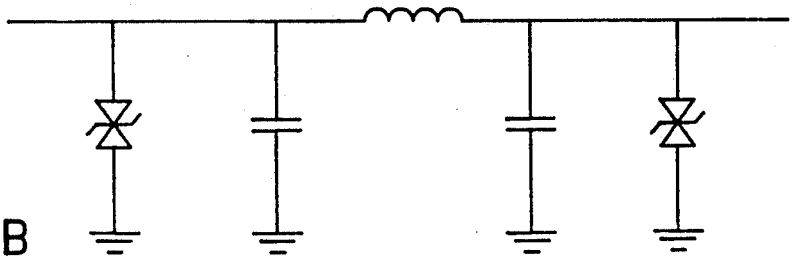

The precise circuitry for filtering and transient suppression is well know, and various examples of filtering circuitry are shown for example in FIGS. 14A and 14B. The precise circuitry is not the subject of the present invention. The present invention is concerned instead with the packaging of this circuitry in a space efficient manner within an electrical connector and achieves significant space and cost advantages by the use of printed circuit boards, preferably having surface mounted components associated therewith, as taught herein.

The filter circuits 22, illustrated in FIG. 1B, are typically of the type shown in FIG. 14A and provide RFI and EMP protection. The configuration of the filter circuits 22 is illustrated in greater detail in FIGS. 12A, 12B and 13, which will be described hereinbelow.

Figure 2A:
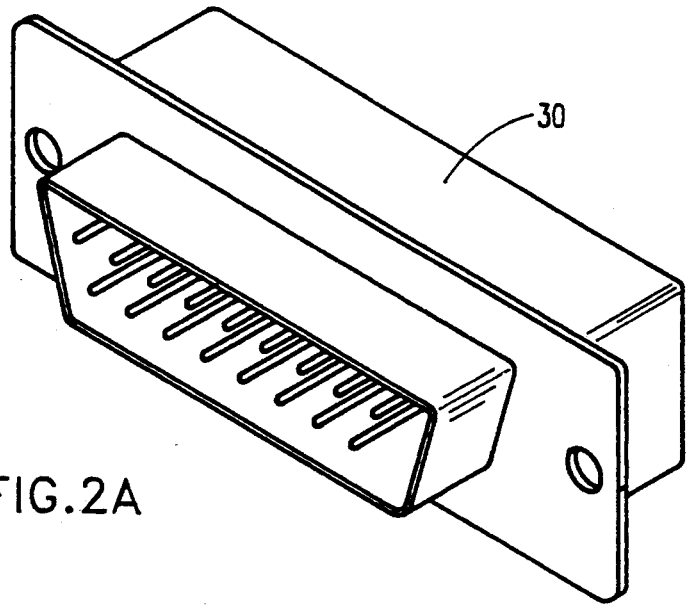
FIGS. 2A and 2B are respective pictorial and exploded views of an electrical connector constructed and operative in accordance with another preferred embodiment of the present invention.
Figure 2B:
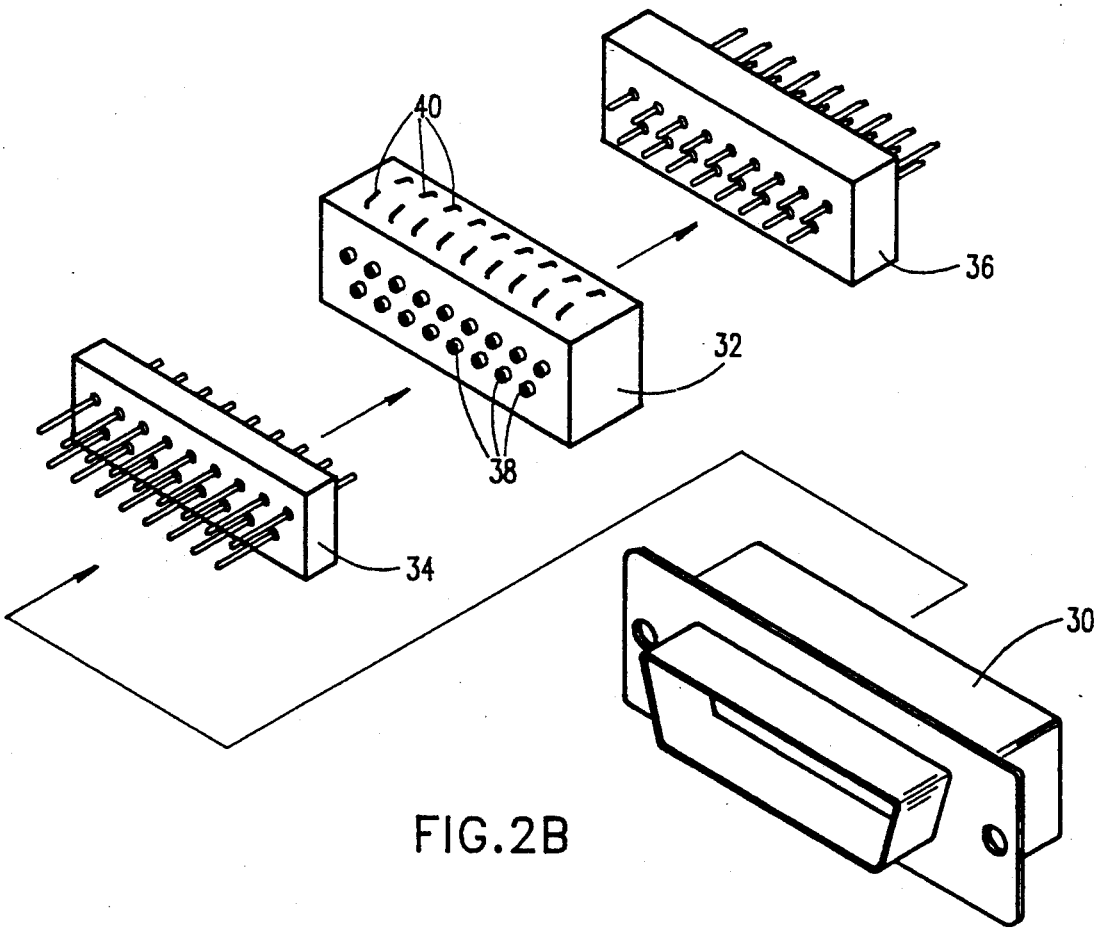

Reference is now made to FIGS. 2A and 2B, which illustrates an alternative embodiment of electrical connector comprising a conductive housing 30 in which are located a filtering assembly 32, preferably embodied in a single hybrid element, and forward and rear insulative pin bearing assemblies 34 and 36, which are arranged for operative engagement with pin sockets 38 in assembly 32. It is noted that filtering assembly 32 includes a plurality of ground conductors 40. These conductors are arranged to electrically contact the housing 30, which serves as a common ground sleeve.

Figure 3:
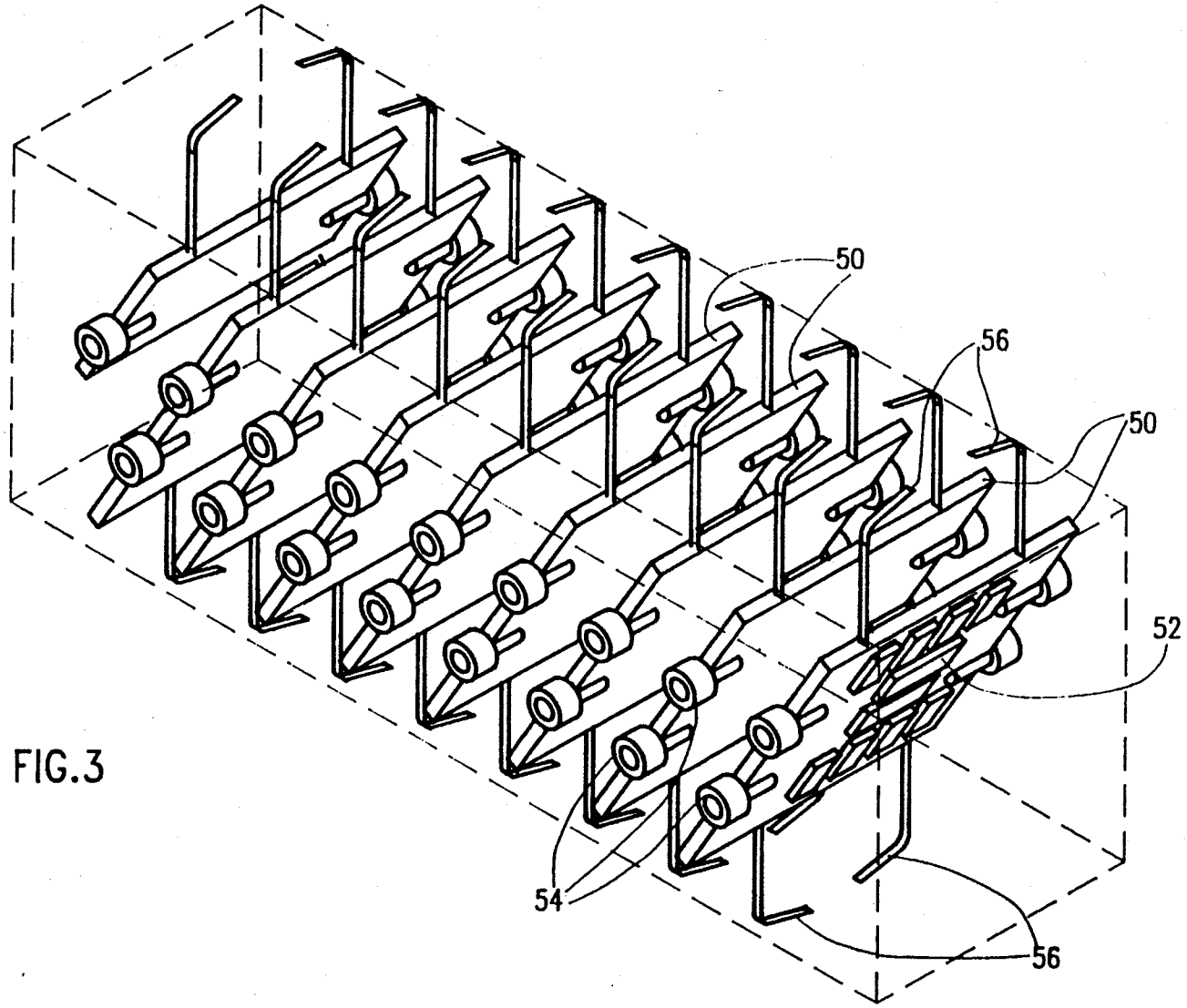
FIG. 3 is a pictorial illustration of a filter assembly useful in the connector of FIGS. 2A and 2B.

Reference is now made to FIG. 3, which illustrates a filtering assembly of the type useful in a connector such as that illustrated in FIGS. 2A and 2B. The filtering assembly comprises a plurality of printed circuit boards 50, each containing filtering and transient suppression circuitry 52 connected to a plurality of pin sockets 54, edge mounted onto the circuit board. Preferably, the circuitry 52 comprises a plurality of surface mounted circuit components.

As seen in FIG. 3, preferably each circuit board is provided with a plurality of ground connection conductors 56 which are arranged, as illustrated in FIG. 2B, to establish conductive grounding contact with an external grounding sleeve, such as housing 30 (FIG. 2B). It may be appreciated from a consideration of FIG. 3 that in accordance with a preferred embodiment of the present invention, a high density of filtering circuitry may be located within a conventional sized connector.

Figure 4:
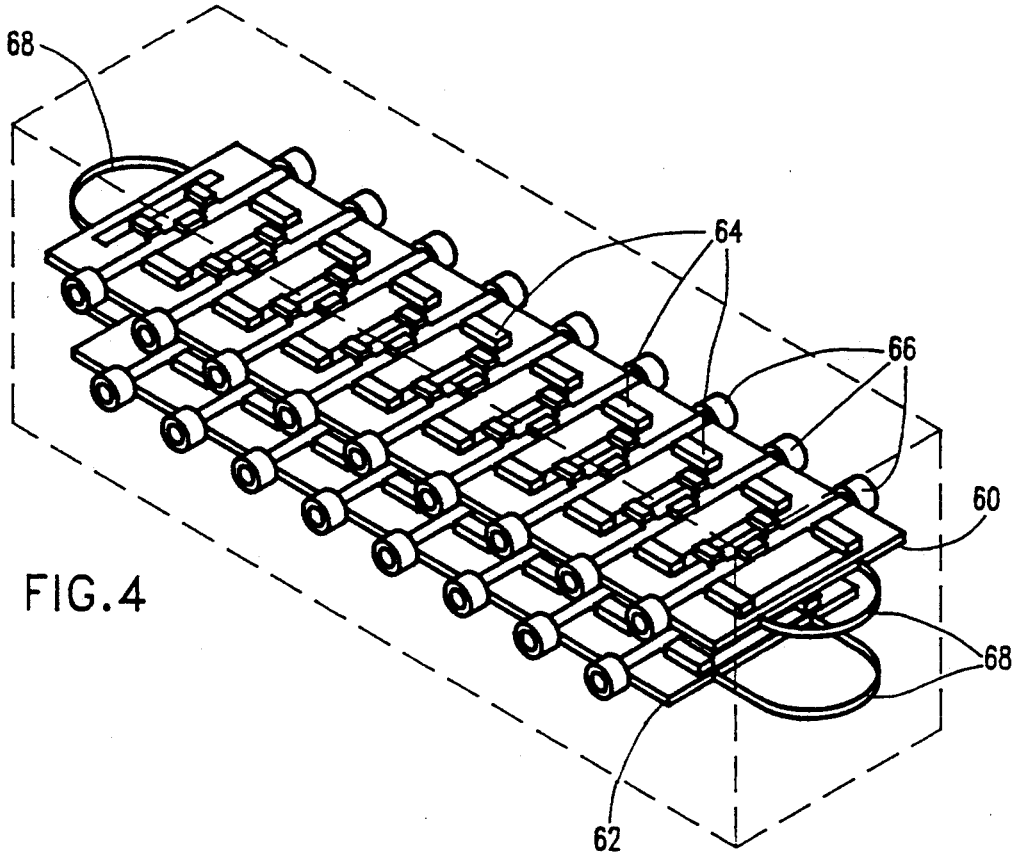
FIG. 4 is a pictorial illustration of another filter assembly useful in the connector of FIGS. 2A and 2B.

Reference is now made to FIG. 4, which illustrates an alternative configuration of filtering assembly suitable for use in the filter of FIGS. 2A and 2B. Here a pair of circuit boards 60 and 62 are employed, each having associated therewith a plurality of filtering circuits 64 interconnecting a plurality of pin sockets 66. Ground conductors 68 are illustrated at the ends of each circuit board.

Figure 5:
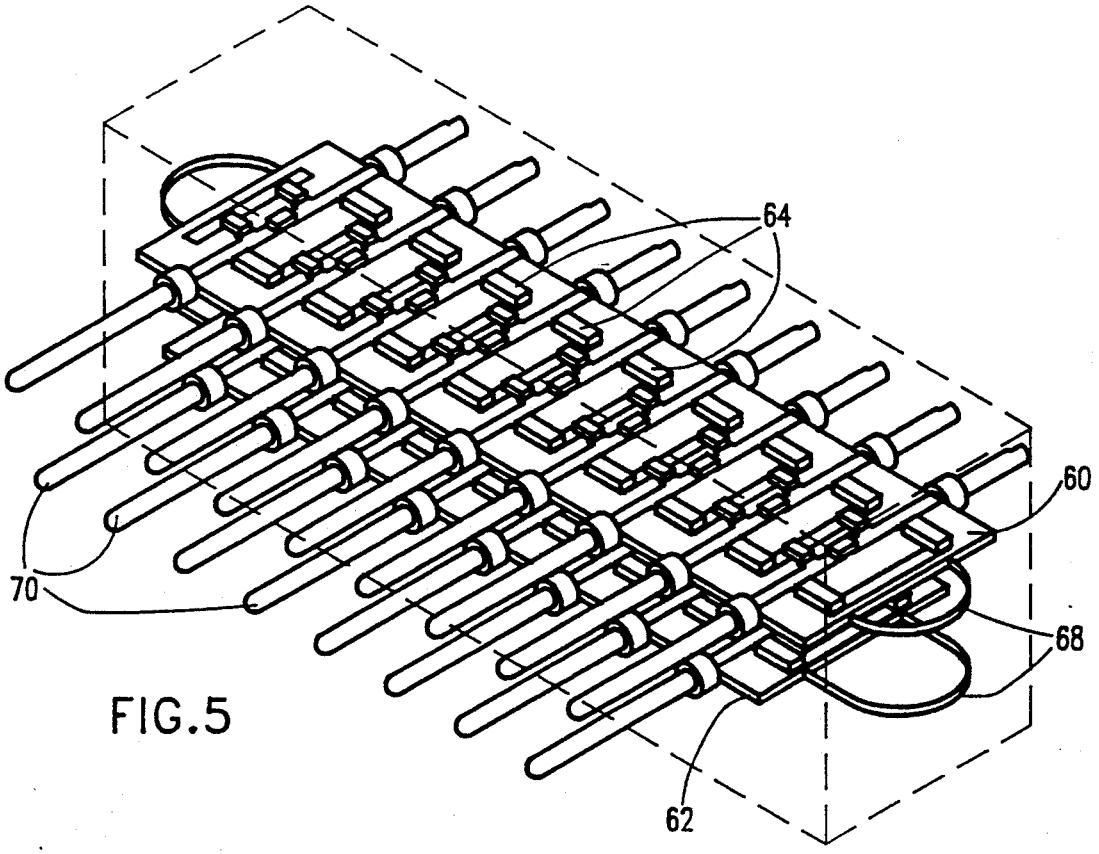
FIG. 5 is a pictorial illustration of a filter assembly useful in the connector of FIGS. 1A and 1B.

FIG. 5 illustrates a further alternative embodiment of filtering assembly, which is similar to that of FIG. 4, but includes a plurality of pins 70 and thus is suitable for use in the filter of FIGS. 1A and 1B.

Figure 6:
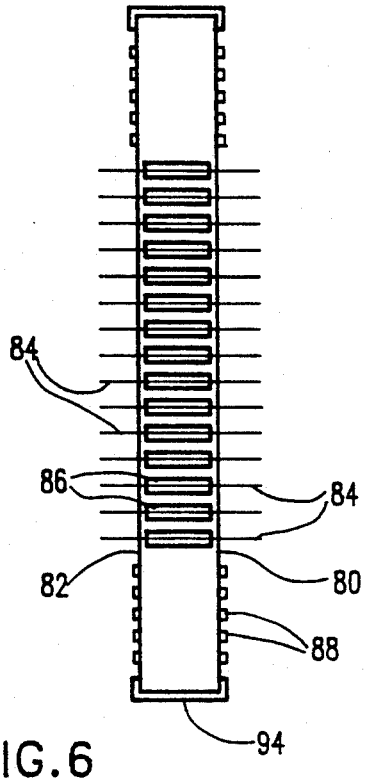
FIG. 6 is a simplified sectional illustration of a circular connector constructed and operative in accordance with another embodiment of the present invention.
Figure 7:
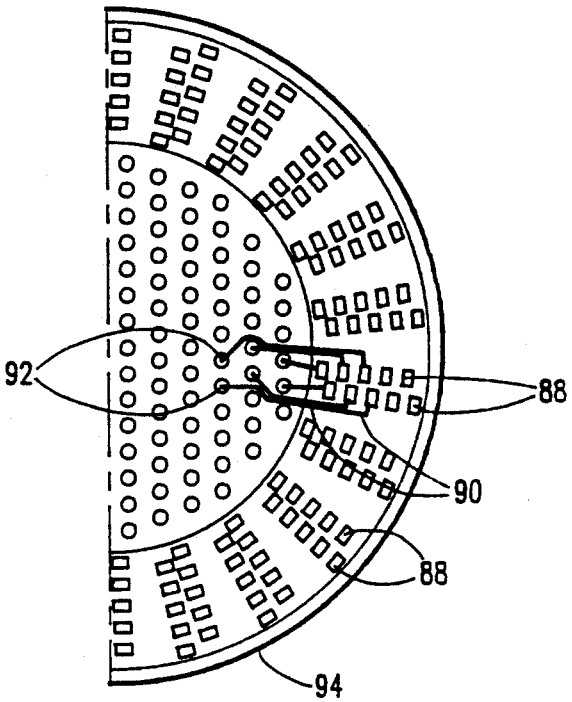
FIG. 7 is a plan view illustration of part of a printed circuit board useful in the connector of FIG. 6.

Reference is now made to FIGS. 6 and 7, which illustrate a filter connector of circular configuration, constructed and operative in accordance with a preferred embodiment of the present invention. The filter connector typically comprises a pair of circuit boards 80 and 82 intermediate which extend a plurality of pins 84, each of which extends through a ferrite bead 86. As in other embodiments of the invention described hereinabove, the circuit boards 80 and 82 each preferably have surface mounted thereon filtering components 88, which are connected to the various pins 84 by means of conductors 90 and typically via plated through apertures 92 formed on circuit boards 80 and 82. The pair of circuit boards 80 and 82 may be held together by a peripheral enclosure and grounding member 94.

Figure 9:
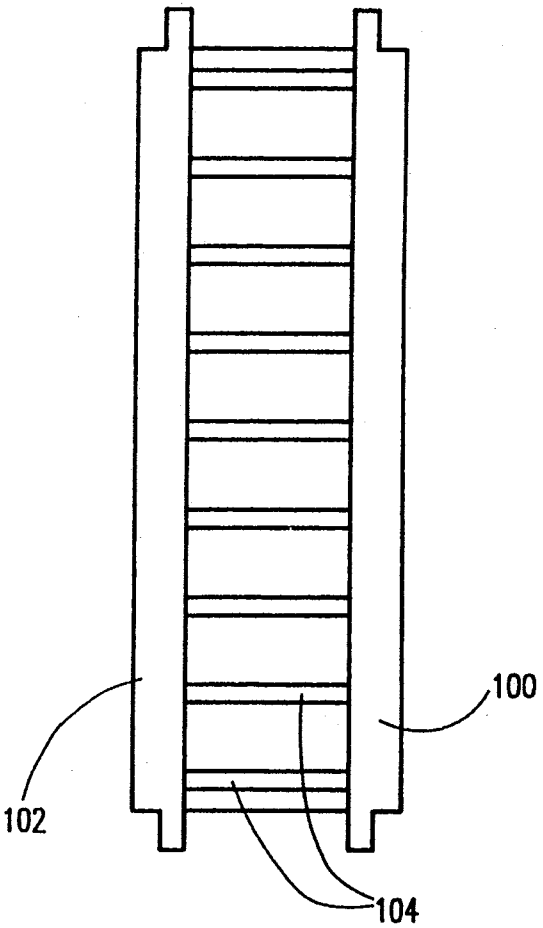
FIGS. 8 and 9 are respective side and edge view illustrations of an electrical connector constructed and operative in accordance with another preferred embodiment of the invention.
Figure 8:
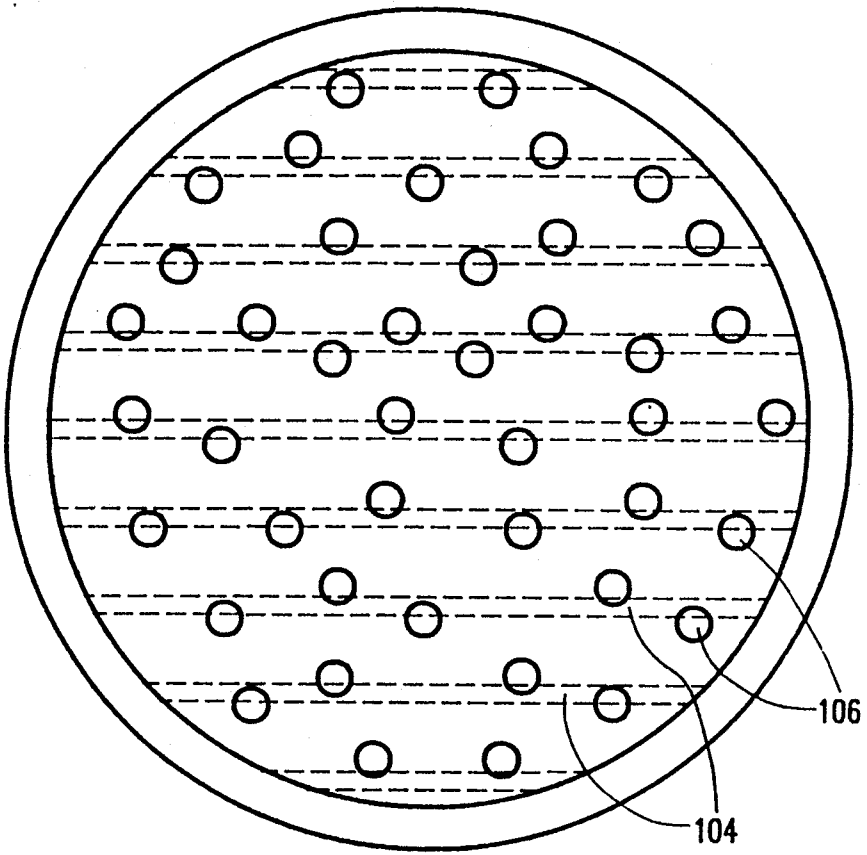

Reference is now made to FIGS. 8 and 9, which illustrate another configuration of circular filter connector comprising first and second generally planar end plates 100 and 102 which support a plurality of printed circuit boards 104, which extend generally perpendicularly thereto. Each of end plates 100 and 102 is provided with a plurality of apertures 106 which are positioned with respect to circuit boards 104 so as to enable pins to extend therethrough into operative engagement with corresponding sockets at the edges of the printed circuit boards 104.

Figure 10:
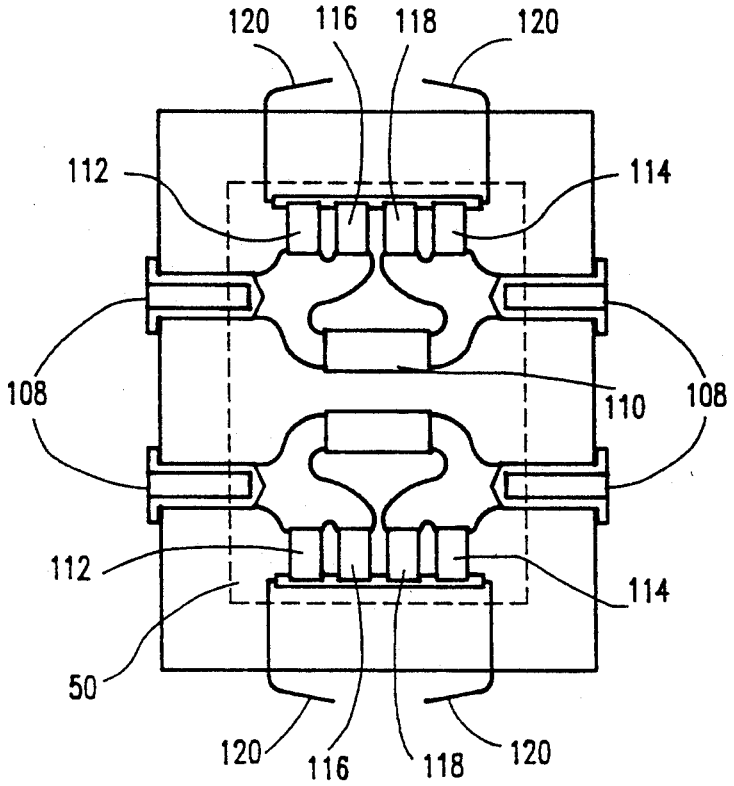
FIG. 10 is a pictorial illustration of a printed circuit useful in the embodiment of FIG. 3.
Figure 11:
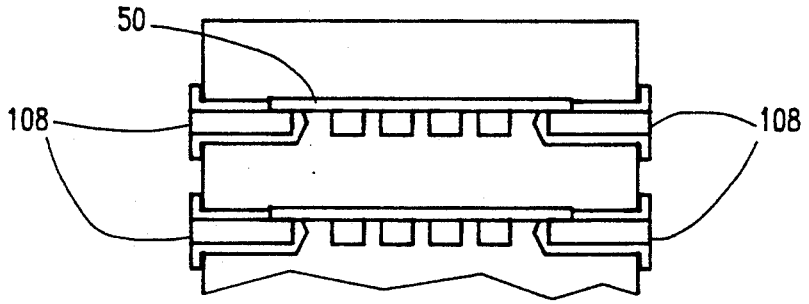
FIG. 11 is a sectional illustration of a plurality of printed circuits of the type illustrated in FIG. 10, employed in a hybrid element such as that shown in FIG. 3.

FIGS. 10 and 11 illustrate exemplary circuit boards which may be employed in the embodiment of FIG. 3. It is seen that the pin sockets 108 are interconnected with SMD (surface mounted device) filter components including a coil 110 and transient voltage suppressors 112 and 114 and capacitors 116 and 118. Ground conductors 120 are provided for operative engagement with a grounding sleeve such as housing 30 (FIG. 2B). A preferred embodiment of filter circuitry useful in the connector of FIG. 3 is illustrated in FIG. 14B.

In the embodiment of FIGS. 10 and 11, the pin sockets 108 are direct mounted onto the corners of the printed circuit boards 50.

Figure 12A:
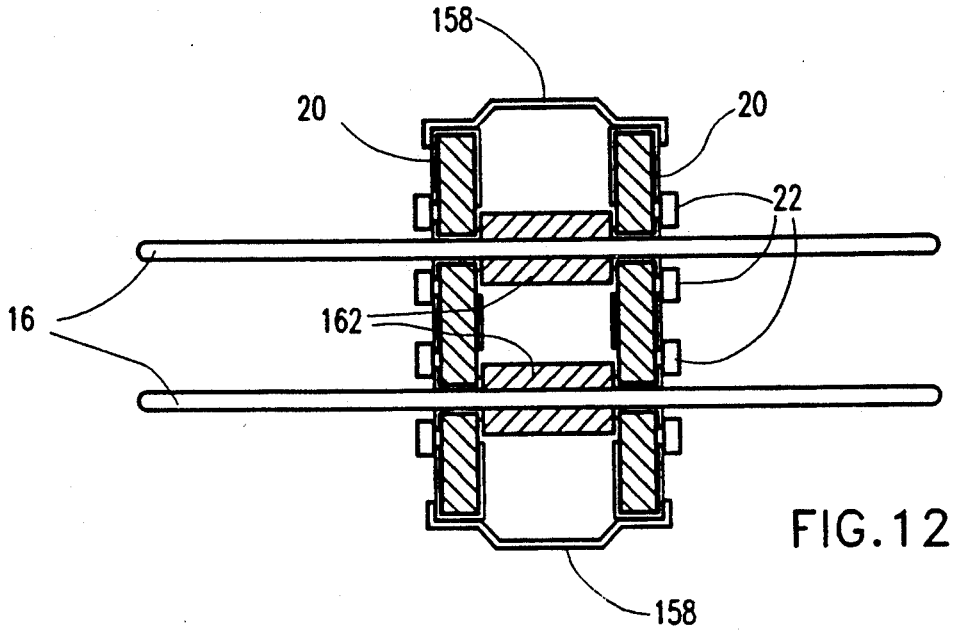
FIGS. 12A and 12B are respective assembled and exploded sectional view illustrations of the filter assembly 18 of FIG. 1B.
Figure 12B:
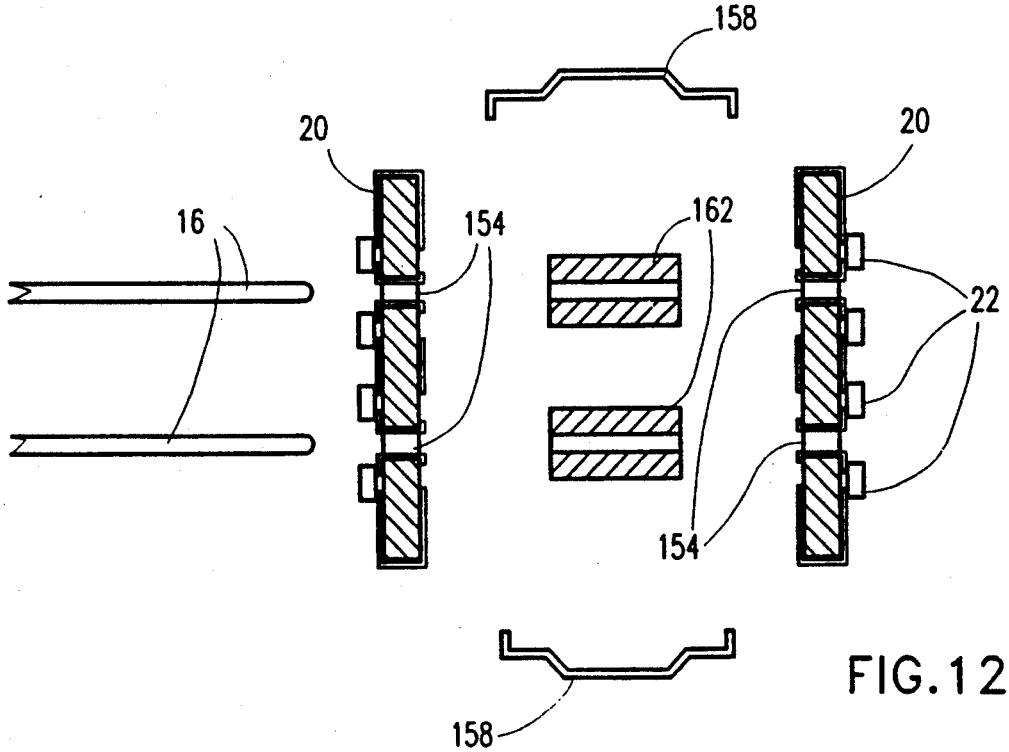

Reference is now made to FIGS. 12A and 12B which illustrate in greater detail, the structure of filtering assembly 18 (FIG. 1B). Here it is seen that the pair of circuit boards 20 having plated through apertures 154 and filter components 22 surface mounted thereon are held together by at least one peripheral mounting and grounding element 158. Pins 16 extend through the apertures 154 and through ferrite beads 162, as shown.

Figure 13:
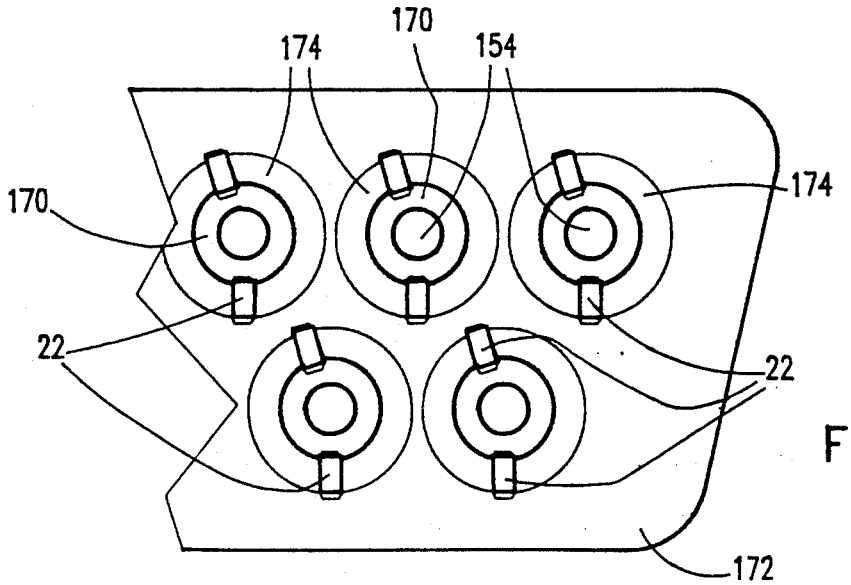
FIG. 13 is an enlarged pictorial illustration of a portion of the printed circuit board 20 in the embodiment of FIG. 1B.

Reference is now made to FIG. 13 which illustrates in enlarged format, a portion of circuit board 20 wherein surface mounted filter components 22 are mounted directly onto the peripheral edge 170 of plated through apertures 154 (FIG. 12B) such that one terminal of the component is in electrical contact with the conductive peripheral edge and another terminal of the component is in electrical contact with a conductive surface 172 electrically insulated from the plated through apertures 154 by an unplated annular dielectric region 174.

It will be appreciated by persons skilled in the art that the present invention is not limited to what has been particularly shown and described hereinabove. Rather the scope of the present invention is defined only by the claims which follow.

I claim:

1. A filter connector comprising:

a housing;

a plurality of connector terminals;

a plurality of printed circuit boards having mounted thereon filter components, wherein said filter components are surface mounted onto said printed circuit boards, all of said printed circuit boards being permanently attached together in a single hybrid element; and means for providing electrical connections between the filter components and the plurality of connector terminals, and wherein said printed circuit boards and said means for providing electrical connections between the filter components and the plurality of connector terminals are all incorporated in said single hybrid element.

2. A filter connector according to claim 1 and wherein said means for providing electrical connections comprises a plurality of circuit board edge connectors.

3. A filter connector according to claim 1 and also comprising forward and rear insulative pin bearing assemblies for engagement with said means for providing electrical connections.

4. A filter connector according to claim 1 and wherein said single hybrid element comprises a plurality of ground conductors and said housing is a conductive housing which contacts said plurality of ground conductors and serves as a common ground sleeve.

5. A filter connector according to claim 2 and wherein said single hybrid element comprises a plurality of ground conductors and said housing is a conductive housing which contacts said plurality of ground conductors and serves as a common ground sleeve.

6. A filter connector according to claim 1 and wherein said single hybrid element comprises a plurality of ground conductors and said housing is a conductive housing which contacts said plurality of ground conductors and serves as a common ground sleeve.

7. A filter connector according to claim 1 and wherein said single hybrid element comprises a plurality of ground conductors and said housing is a conductive housing which contacts said plurality of ground conductors and serves as a common ground sleeve.

8. A filter connector according to claim 3 and wherein said single hybrid element comprises a plurality of ground conductors and said housing is a conductive housing which contacts said plurality of ground conductors and serves as a common ground sleeve.

* * * * *

US005236376C1

(12) EX PARTE REEXAMINATION CERTIFICATE (4981st)

United States Patent
Cohen

(10) Number: US 5,236,376 C1
(45) Certificate Issued: Aug. 31, 2004

(54) CONNECTOR

(75) Inventor: Amir Cohen, Moshav Be'er Tuvia, 70996 (IL)

(73) Assignee: Amir Cohen, Moshav Be'er Tuvia (IL)

Reexamination Request:
No. 90/005,277, Mar. 1, 1999

Reexamination Certificate for:

| | |
|---|---|
| Patent No.: | **5,236,376** |
| Issued: | **Aug. 17, 1993** |
| Appl. No.: | **07/837,919** |
| Filed: | **Feb. 20, 1992** |

(30) Foreign Application Priority Data

Mar. 4, 1991 (IL) ..... 97425

(51) Int. Cl.[7] ..... H01R 13/66

(52) U.S. Cl. ..... 439/620; 361/56; 361/111; 333/185

(58) Field of Search ..... 439/620; 361/56, 361/111; 333/185

(56) References Cited

U.S. PATENT DOCUMENTS

| | | | |
|---|---|---|---|
| 4,781,624 A | 11/1988 | Shepherd | 439/620 |
| 5,034,846 A | 7/1991 | Hodge et al. | 361/119 |

*Primary Examiner*—Gary F. Paumen

(57) ABSTRACT

A filter connector including a housing, a plurality of connector terminals, at least one printed circuit board having mounted thereon surface mounted filter components and apparatus for providing electrical connections between the surface mounted filter components and the plurality of connector terminals.

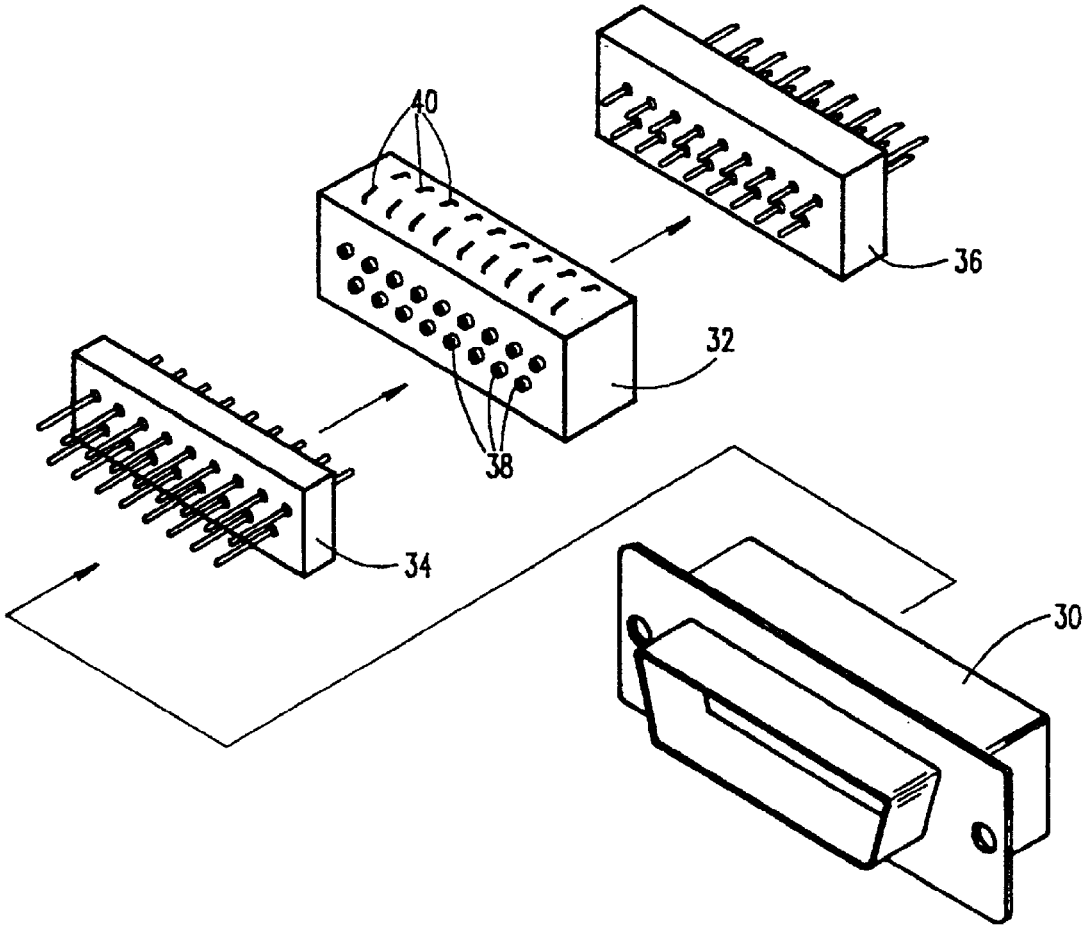

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 6 and 7 are cancelled.

Claims 1 and 3 are determined to be patentable as amended.

Claims 2, 4, 5 and 8, dependent on amended claim, are determined to be patentable.

1. A filter connector comprising:

a housing;

a plurality of connector terminals;

a plurality of printed circuit boards having mounted thereon filter components, wherein said filter components are surface mounted onto said printed circuit boards, all of said printed circuit boards being permanently attached together in a single hybrid element; and means for providing electrical connections between the filter components and the plurality of connector terminals, and wherein said printed circuit boards and said means for providing electrical connections between the filter components and the plurality of connector terminals are all incorporated in said single hybrid element;

*wherein each of said printed circuit boards is formed with a generally contiguous conductive surface formed on a majority of a face of the circuit board, and a plurality of plated through apertures electrically insulated from the conductive surface by an unplated annular dielectric region,*

*and wherein at least one of said filter components is mounted directly onto peripheral edges of said plated through apertures, wherein one terminal of the component is in electrical contact with the peripheral edge and another terminal of the component is in electrical contact with the conductive surface.*

3. A filter connector [according to claim 1] *comprising:*

*a housing;*

*a plurality of connector terminals;*

*a plurality of printed circuit boards having mounted thereon filter components, wherein said filter components are surface mounted onto said printed circuit boards, all of said printed circuit boards being permanently attached together in a single hybrid element;*

*means for providing electrical connections between the filter components and the plurality of connector terminals, and wherein said printed circuit boards and said means for providing electrical connections between the filter components and the plurality of connector terminals are all incorporated in said single hybrid element;* and [also comprising]

forward and rear insulative pin bearing assemblies for engagement with said means for providing electrical connections.

* * * * *